US007832676B2

(12) United States Patent
Gelli

(10) Patent No.: US 7,832,676 B2
(45) Date of Patent: Nov. 16, 2010

(54) REWINDING MACHINE, FOR THE PRODUCTION OF LOGS OF WEB MATERIAL AND LOGS OBTAINED

(75) Inventor: Mauro Gelli, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 1169 days.

(21) Appl. No.: 10/581,621

(22) PCT Filed: Nov. 25, 2004

(86) PCT No.: PCT/IT2004/000651

§ 371 (c)(1),
(2), (4) Date: Jun. 5, 2006

(87) PCT Pub. No.: WO2005/054103

PCT Pub. Date: Jun. 16, 2005

(65) Prior Publication Data

US 2008/0283656 A1 Nov. 20, 2008

(30) Foreign Application Priority Data

Dec. 5, 2003 (IT) ..... FI2003A0311

(51) Int. Cl.
*B65H 35/10* (2006.01)

(52) U.S. Cl. ..... 242/521; 242/532.2; 242/533

(58) Field of Classification Search ..... 242/526.1, 242/527.2, 532.2, 527.3, 526.2, 526, 533, 242/533.4, 535.4, 527, 521
See application file for complete search history.

(56) References Cited

U.S. PATENT DOCUMENTS 4,327,877 A 5/1982 Perini
4,487,377 A 12/1984 Perini
4,512,528 A * 4/1985 Kuhn ..... 242/533
4,909,492 A 3/1990 Biagiotti
5,031,850 A 7/1991 Biagiotti
5,040,738 A 8/1991 Biagiotti
5,137,225 A 8/1992 Biagiotti
5,248,106 A 9/1993 Biagiotti
5,249,756 A 10/1993 Biagiotti
5,267,703 A 12/1993 Biagiotti
5,368,252 A 11/1994 Biagiotti
5,538,199 A 7/1996 Biagiotti
5,542,622 A 8/1996 Biagiotti
5,639,046 A 6/1997 Biagiotti
5,690,296 A 11/1997 Biagiotti
5,725,176 A * 3/1998 Vigneau ..... 242/533.4
5,769,352 A 6/1998 Biagiotti
5,839,680 A 11/1998 Biagiotti
5,849,357 A * 12/1998 Andersson ..... 242/533
5,979,818 A 11/1999 Perini et al.

(Continued)

FOREIGN PATENT DOCUMENTS

EP 0 199 286 A2 10/1986

(Continued)

*Primary Examiner*—William A Rivera
(74) *Attorney, Agent, or Firm*—Breiner & Breiner, L.L.C.

(57) ABSTRACT

The rewinding machine includes a winding system and a path for feeding a web material towards said the winding system. Along the feed path at least one suction member is positioned to temporarily obstruct feeding of the web material and cause interruption thereof at the end of winding of each log.

52 Claims, 7 Drawing Sheets

U.S. PATENT DOCUMENTS

| | | | | |
|---|---|---|---|---|
| 6,056,229 | A | 5/2000 | Blume et al. | |
| 6,752,344 | B1 | 6/2004 | Biagiotti | |
| 7,392,961 | B2 * | 7/2008 | McNeil et al. | 242/535.4 |
| 2002/0017587 | A1 | 2/2002 | McNeil et al. | |

FOREIGN PATENT DOCUMENTS

| | | | |
|---|---|---|---|
| EP | 1 219 555 | A1 | 7/2002 |
| GB | 1 435 525 | | 5/1976 |
| GB | 2 105 687 | A | 3/1983 |
| GB | 2 150 536 | A | 7/1985 |
| IT | MI1995A001174 | | 8/1997 |
| JP | 06-135604 | | 5/1994 |
| WO | WO 01/72620 | A1 | 10/2001 |
| WO | WO 2004/035441 | A1 | 4/2004 |
| WO | WO 2004/046006 | A2 | 6/2004 |
| WO | WO 2004/050520 | A2 | 6/2004 |
| WO | WO 2004/071914 | A1 | 8/2004 |

* cited by examiner

REWINDING MACHINE, FOR THE PRODUCTION OF LOGS OF WEB MATERIAL AND LOGS OBTAINED

TECHNICAL FIELD

The present invention concerns a rewinding machine for winding a web material to form logs intended for example but not exclusively for the production of toilet rolls, kitchen paper and similar. More in particular, but not exclusively, the invention concerns a so-called surface rewinding machine, i.e. in which the logs are formed by winding the web material in a winding cradle formed by winding members in contact with the outer surface of the log. The invention also concerns a winding method and more in particular, but not exclusively, a so-called surface winding method.

According to a further aspect, the invention concerns logs of wound web material with or without central winding core.

STATE OF THE ART

For the production of logs of paper, so-called tissue paper or other web materials rewinding machines are used to which the material to be wound is fed, and which produce logs with a pre-set quantity of wound material. The web material is fed typically by unwinders, i.e. machines that unwind one or more large diameter reels coming, for example, from a paper mill.

The logs can be sold as is, or can undergo further transformation operations; typically they are cut into logs of shorter axial length, equal to the final dimension of the rolls offered for sale.

The rewinding is in some cases performed by so-called central rewinding machines, i.e. in which the logs are formed around motor-driven mandrels, on which winding cores made of cardboard or similar material may be fitted, designed to remain inside the logs.

The latest rewinding machines are based on the principle of so-called peripheral or surface winding. In this case the log forms in a winding cradle, defined by rotating winding rollers or by other winding members such as belts, or combinations of rollers and belts.

Combined systems are also known in which the winding is obtained by means of surface members, combined with a system for control of the log axis in the formation phase. In both the central winding systems and surface winding systems machines are sometimes used in which the mandrel or winding core is extracted from the finished log so that the end product is a log provided with a central hole, without axial core. Examples of surface rewinding machines of this type are described in WO-A-0172620.

The rewinding machines, both surface and central, operate automatically and continuously, i.e. the web material is fed in continuously without stopping and at a substantially constant speed. The web material is provided with crosswise perforation lines which divide the material into single portions which can be separated from the log for the end use. Typically the aim is to produce logs with a pre-set and precise number of said portions or sheets.

When a roll or log has been completed, the switchover phase must be performed in which the log formed is discharged and the web material is interrupted, forming a final edge of the complete log and an initial edge of the subsequent log. The initial edge begins to wind to form a new log. The interruption occurs preferably along a perforation line, so that the end product contains a whole pre-set number of portions of web material.

These operations take place without substantial variations in the feed speed of the web material and represent the most critical moment of the winding cycle. In modern rewinding machines for the production of tissue paper, the feed speed of the web material reaches and exceeds speeds in the order of 1000 m/min, with winding cycles at times lasting less than 2 seconds.

It is therefore important to provide efficient, reliable and flexible systems for interruption of the web material at the end of winding of each roll or log.

In GB-A-1435525 a rewinding machine is described in which interruption of the web material is performed by means of a blade or jet of compressed air which tears the web material or generates a loop which wedges between the new winding core inserted in the winding cradle and one of the winding rollers.

In U.S. Pat. No. 4,327,877 a rewinding machine is described in which the web material is interrupted by the combined action of suction across the surface of one of the winding rollers and pinching of the web material between the new core inserted in the winding cradle and the suction winding roller. The suction forms a loop of material which is pinched and pulled in the opposite direction with respect to that of feed of the web material which winds around the log as it is being completed.

In GB-A-2150536 and U.S. Pat. No. 5,368,252 rewinding methods and machines are described in which the web material is torn at the end of winding solely by means of controlled acceleration of one of the winding rollers. The same system based on the principle of tearing the web material along a perforation line by means of acceleration of one of the winding rollers is described in EP-A-1.219.555.

In GB-A-2105687 a rewinding method and a machine are described in which interruption of the web material is performed via cutting by a blade in a channel of one of the winding rollers.

In U.S. Pat. No. 5,137,225 and EP-A-0199286 rewinding methods and machines are described in which the tear is performed by cooperation of a winding core with a fixed surface against which the core pinches the web material causing it to stop or temporarily slow down.

In IT-B-1.275.313 a device is described in which the web material is torn by a core taker-in which cooperates with the main winding roller.

In U.S. Pat. No. 6,056,229 a rewinding machine is described in which the web material is interrupted by pinching it between a fixed surface and a movable member which also constitutes the machine winding core taker-in.

A particularly reliable and flexible method and machine are described in U.S. Pat. No. 5,979,818. In this case the tear is performed by a movable member which cooperates with one of the winding rollers around which the web material is guided, or with a belt running around said roller and which sustains the web material as it is fed towards the winding cradle. The difference in speed between the winding roller and the web material on the one hand and the movable member on the other causes tearing of the web material along a perforated line. With respect to the preceding tear systems, this known rewinding machine permits very high winding precision, also at high speed, with a relatively simple and economic configuration, which also permits high production flexibility.

From the evolution represented by the machines and methods described in the above-mentioned patents, it is evidently necessary to produce tear and winding start systems that are increasingly efficient and reliable also at high speeds and which permit a high level of flexibility, i.e. the possibility of varying the winding parameters in a simple manner, in particular the length of web material wound on each log or the distance between successive perforation lines on the web material.

OBJECTS AND SUMMARY OF THE INVENTION

The object of the invention is to produce a winding method and a rewinding machine that are particularly efficient, economic and reliable and which guarantee a high level of production flexibility.

These and further objects and advantages, which will appear clear to persons skilled in the art from reading of the following text, are substantially obtained with a surface rewinding machine comprising: a winding system and a path for feeding a web material towards said winding system, in which a suction member is positioned along the winding path to temporarily obstruct feeding of the web material and cause breakage thereof at the end of winding of each log.

The winding system is advantageously a surface type winding system, comprising a winding cradle, for example defined by a plurality of winding rollers. It is also possible, however, for the winding system to be of the central type, i.e. in which the log being formed is kept rotating by a mandrel or axial centers.

The suction, applied in a synchronized manner with the remaining functions of the machine and for a brief interval of time on the web material along the feed path, produces a force orthogonal to a counter surface or other element associated with the suction member. The friction thus generated is sufficient to cause sudden braking and consequent breakage of the web material by tearing. Typically, and preferably, the material is torn along a perforation line generated on the web material by the perforator normally provided along the web material path. The suction member can feature one or more apertures, in the form of holes, openings, slots or any other suitable configuration, for applying the suction on the web material. This or these apertures can be provided for example on a counter surface which is preferably fixed, with advantages in terms of construction simplicity and reliability. It is also possible, however, for the apertures to be provided on a movable surface, with a different movement speed, preferably lower than the feed speed of the web material.

The suction is synchronized with the position of the perforation line along which the web material is interrupted at the end of winding of each log. In this way a number of perforation lines and therefore a number of single sheets of web material are obtained on each log determined in a precise manner. Furthermore, the perforation line represents a breaking trigger point, with reduced tensile strength, and this facilitates tearing by suction.

The rewinding machine has considerable advantages with respect to the known devices. It is characterized by the same operating flexibility and the same reliability as the machines described in U.S. Pat. No. 5,979,818, but does without the mechanical member which tears the web material. Fewer mechanical parts makes the machine less expensive, simpler to manage and in the last analysis also more reliable. Furthermore, elimination of the mechanical action of the web material tear device reduces wear, vibration and noise. With respect to the known systems which tear the web material by acceleration of one of the winding rollers, the machine according to the invention has advantages in terms of cost, reliability and production speed, in addition to greater winding precision, with the possibility of more accurate and reliable adjustment of the position of the point of breakage, interruption or tearing of the web material, also at very high speeds.

As will appear clear from the description of some embodiment examples, the suction breaking system furthermore permits—if required—elimination of the glue for starting winding of the web material on each winding core or mandrel, with a series of advantages which will appear clear to persons skilled in the art. Unlike other known devices which do not use glue to start the winding process, the system of the present invention permits very high speeds and considerable reliability, in addition to a high quality end product in which no wrinkles are formed in the inner turns as occurs in the known systems.

U.S. Pat. No. 4,327,877 describes a rewinding machine in which suction is used to begin interruption or tearing of the web material. However, in the technology described in said patent, the suction is not used to delay or obstruct feed of the web material but to modify its path so that it is inserted between the lower winding roller and a new winding core inserted in the nip between the first and second winding roller. Actual tear is a consequence of the fact that two spaced points of the web material are fed in opposite directions until the web material breaks in an area between said two points.

The inventive concept defined above can be applied both in rewinding machines that produce logs with a winding core which is kept inside the end product, for example a cardboard or plastic core, and in machines that produce logs without winding core, in which the log is formed around a mandrel or core which is then extracted from the wound product, before the latter is cut into smaller logs. The end product is in this case without central core and features an axial hole.

The rewinding machine is advantageously provided with a winding core feeder, to feed winding cores along an insertion path towards the winding cradle.

When the rewinding machine is designed to produce logs around winding cores, a feed member for said cores can be advantageously provided along the winding core insertion path. The feed member can consist, for example, of a flexible member consisting of one or more belts defining a closed path.

According to an advantageous form of embodiment of the invention, a rolling surface for said cores can be provided along the core insertion path, which forms with the feed member a winding core insertion channel. In this way the cores fed along the insertion path move forward by rolling between the feed member and the fixed rolling surface. In an advantageous embodiment of the invention, the rolling surface and the core feed member which form the winding core insertion channel are arranged so that the web material is fed between the core and the feed member when the core is in the insertion path. In this way the core begins to roll along the insertion path and, once the web material has been interrupted, the initial free edge produced winds around the core which is already rotating.

Winding can be started by applying glue on the core in one or more suitable areas, for example distributed according to a longitudinal strip, i.e. parallel to the core axis. Alternatively, or in combination, the initial free edge of the web material can be wound around the core to form the first turn assisted by one or more nozzles that generate appropriately directed jets of air, if necessary with adjustable direction during the winding start phase.

In a possible and preferred embodiment, the rewinding machine comprises a counter surface, along which the web material and core feed member run and along which the suction member applies suction on the web material. The counter surface is preferably fixed and is combined, for example, with a negative pressure chamber with members for rapid opening and closing of suction openings or apertures, via which the suction is applied to the web material which runs along the surface. When the rewinding machine is designed to produce logs around winding cores, the core feed member is arranged and designed to feed the cores along said counter surface. For example, one or more continuous flexible members can be provided, such as belts or other, which move forward with one of their branches substantially parallel and adjacent to the counter surface, for example in channels or housings purposely provided in the counter surface, so that the core can be pressed against the fixed surface to pinch the web material between the fixed surface and the core itself, facilitating beginning of winding of the web material.

The suction member can comprise a sliding valve for rapid opening and closing of suction holes, or suction apertures or openings via which said suction member applies suction to said web material, said sliding valve being activated in conjunction with a switchover phase of the winding cycle performed by said rewinding machine. Activation is synchronized with a perforation line so that the braking effect on the web material is exerted when a perforation line has just passed in front of the suction slot. This permits easy breakage of the web material along said perforation line.

The winding cradle can be produced in various ways. Preferably it comprises at least one first winding roller. In said case at least one flexible member with which the web material fed to said winding cradle is in contact can run around the first winding roller. Furthermore, the flexible member can be advantageously combined with the suction member which can be provided with a fixed counter surface, the flexible member moving along said counter surface.

The winding cradle can also comprise a second winding roller, defining with the first winding roller a nip through which the web material to be wound passes and through which the winding cores pass. In this case, the nip can be advantageously positioned substantially at the end of the core insertion path.

According to a further aspect, the invention concerns a method for the production of logs of wound web material, comprising the following phases:

feeding the web material to a winding system;

winding a first log of web material;

at the end of winding of the first log, interruption of the web material, obstructing the feed thereof by means of timed suction applied on the web material to cause braking or temporary stoppage thereof in a pre-determined area.

Preferably the winding system is of the surface type, i.e. comprising a winding cradle, for example comprising one or more winding rollers, without excluding the possibility of implementing the same method for tearing the web material also in central winding machines.

According to an advantageous embodiment, the web material is fed along a counter surface, advantageously fixed, along which the suction is applied.

The method can be implemented with winding cores or mandrels which remain in the end product or which are extracted after formation of the log. In an advantageous embodiment of the method according to the invention, the cores are advantageously fed along an insertion path towards the winding cradle. Advantageously a winding core can roll along the counter surface, with the web material positioned and fed between the counter surface and the core.

Further advantageous features and embodiments of the rewinding machine and the winding method according to the invention are indicated in the appended claims and will be described in greater detail below with reference to some advantageous embodiment examples.

BRIEF DESCRIPTION OF THE DRAWINGS

The invention will be better understood by following the description of practical and advantageous non-limiting embodiment examples of the invention, shown in the appended drawings. In the drawings.

DETAILED DESCRIPTION OF THE PREFERRED EMBODIMENTS OF THE INVENTION

Figure 1A:
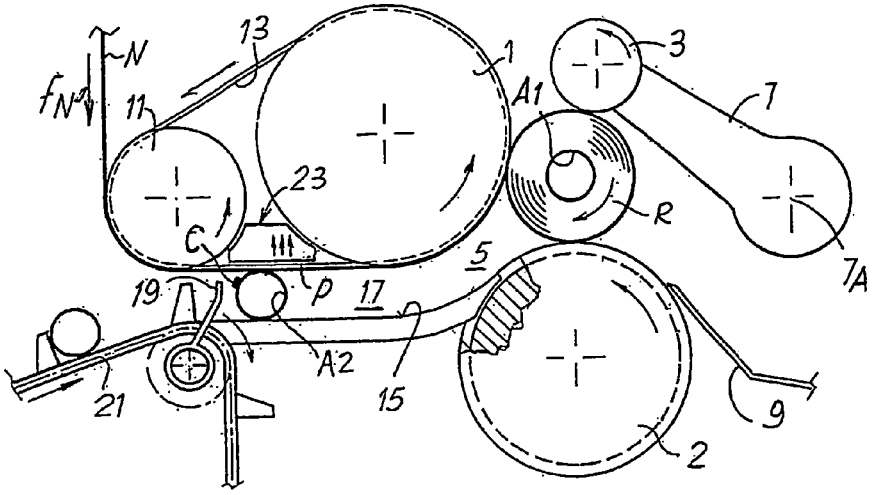
FIG. 1A to 1C show an operating sequence of a machine according to the invention in a first embodiment.

Embodiment examples with a surface winding system are described below. It should, however, be understood that the principles underlying the invention can also be combined with a central winding system.

The appended drawing shows the basic elements of the machine according to the invention, in a representation that illustrates the operating mode thereof. In the embodiment illustrated in FIG. 1A, 1B, 1C, the rewinding machine comprises a winding cradle formed by three winding rollers, namely: a first winding roller 1, a second winding roller 2 and a third winding roller 3. The three rollers 1, 2, 3 rotate around parallel axes and at peripheral speeds which—during the winding cycle—are substantially the same, whereas they can vary in a per se known manner at the end of winding to discharge the complete log and/or to insert the new core, around which winding of the subsequent log has begun, via a nip 5 defined between the winding rollers 1 and 2.

The winding roller 3 is supported on a pair of oscillating arms 7, hinged around an oscillation axis 7A. The oscillation movement permits build-up of the log R being formed inside the winding cradle 1, 2, 3 and discharge of the complete log via a chute 9.

The web material to be wound to form the logs R is indicated by N. It moves along a feed path which crosses a perforation unit (not shown) which perforates the material N in a known manner along perforation lines substantially orthogonal to the feed direction fN of the material N. Downstream of the perforation unit the web material N runs around a guide roller 11 revolving around an axis parallel to the axis of the winding rollers 1, 2 and 3. The web material feed path then proceeds for a section tangent to the rollers 1 and 11 defined by a flexible feed member 13 consisting of a plurality of flat parallel belts running around rollers 1 and 11. The feed member serves above all to insert and feed forward the tubular winding cores A around which the logs R are wound, as will be clarified subsequently. Since the belts forming the feed member 13 run around the rollers 1 and 11, they move forward at the same speed as the web material N and therefore there is no relative movement between the latter and the belts.

Below the portion of the feed member parallel to the web material N, there is a curved rolling surface 15 defined by a metal sheet or bent bar, a plurality of metal sheets or bent bars parallel to each other or a comb-type structure. Between the rolling surface 15 and the feed member 13 an insertion and feed channel for the winding cores is defined, indicated by 17, which is provided with an inlet on the left side of the figures and an outlet corresponding substantially to the nip 5 between the winding rollers 1 and 2. The terminal part of the channel is therefore defined between the rolling surface 15 and the outer surface of the winding roller 1 around which the feed member 13 runs, the rolling surface being arched so that it is roughly coaxial with the surface of the roller 1. The terminal part of the surface 15 penetrates into ring-shaped grooves provided in the winding roller 2, to permit easy passage of the cores that roll on the surface 15 towards the nip 5 and from here to the winding cradle 1, 2, 3.

Near the inlet of the channel 17 a core taker-in is provided, consisting of a rotating element 19 which, at the appropriate moment, inserts a winding core A in the channel 17. The cores are positioned in front of the taker-in 19 by means of a chain conveyor 21. Operation of the core insertion mechanism is known to persons skilled in the art, for example from one or more of the patents referred to in the introductory part of this description, and will not be described in further detail.

The height of the channel 17 is equal to or slightly less than the outer diameter of the winding cores A which, therefore, when they are pushed into said channel by the taker-in 19, are accelerated at an angle and roll on the surface 15 pushed by the movement of the feed member 13. The web material N remains pinched between the belts forming the feed member 13 and the core inserted in the channel.

Above the lower branch of the taker-in member 13 a suction member is provided indicated overall by 23 and described in greater detail below. It has a suction area which extends crosswise to the feed direction of the cores A and to the web material N. The suction member applies suction to the web material N in the switchover phase, i.e. when the log R is almost complete and the web material N must be interrupted to generate a final free edge to be wound on the finished log R and a initial free edge to be wound on a new core A inserted in the channel 17 to start winding of a new log. The suction generates a force orthogonal to the lower surface of the suction member 23. The consequent friction force exerted on the web material by said surface is sufficient to cause tensioning and breakage of the material.

Operation of the machine described so far is as follows. FIG. 1A shows the moment immediately before breakage or interruption of the web material. The log R wound around the winding core indicated by A1 is ready to be expelled from the winding cradle, while a new core A2 has just been inserted by the taker-in 19 into the channel 17. Advantageously, the configuration of the channel 17 is such that the core A2 comes into contact with the belts forming the member 13 and with the roller 11 before coming into contact with the fixed counter surface formed by the lower part of the suction member 23. In this way it is rapidly accelerated at an angle until its contact point with the web material is brought to the same feed speed as the web material.

The rolling surface 15 has a comb-type structure or at least a series of notches which allow the taker-in 19 to complete the rotation around its own rotation axis and prepare for insertion of the next core.

P indicates the position of a crosswise perforation line, generated on the web material N by the perforator (not shown), along which the web material is torn. The perforation P is located immediately downstream of a suction area defined by suction apertures, slots or holes along a lower surface of a suction box formed by the suction member 23. The suction is controlled and timed in order to operate when the perforation line P is in the position indicated in FIG. 1A, or slightly farther downstream in the feed direction of the web material N. In this way, when the suction is activated, the web material is braked sharply, in the area where the suction holes or apertures are located. As the log R continues to rotate, the web material between the tangent point with the log R and the suction area is tensioned and tears along the perforation line P, which constitutes the weakest section of the web material. The winding roller 1 has a surface with a high friction coefficient between the belts 13A that form the member 13, so that tearing of the web material occurs on the perforation line nearest the area in which the suction is applied. In practice, the high friction coefficient of the surface of the roller 1 with which the web material N is in contact prevents spreading of the tension downstream, towards the log R1 which is being completed.

The core A2 is already in contact with the web material N upstream of the tearing and suction area and has already been set to rotation. It holds the web material N against the belts forming the feed member 13 and thus prevents loss of the initial free edge Li of web material N that has formed due to the tear. Furthermore the core circumscribes and limits the stretch of web material that slackens due to the braking imposed by the suction. In fact, the web material upstream of the contact area with the core A2 does not slacken, with consequent advantages in terms of absence of wrinkles in the turns inside the log. The final free edge Lf of the log R finishes winding on the log, which is expelled by varying the peripheral speed of the roller 2 and/or of the roller 3, in a per se known manner. To facilitate tearing or interruption of the web material by means of the suction applied on it, it is also possible to temporarily accelerate the winding roller 3 before activating the suction. This acceleration, even slight, pretensions the web material and guarantees tearing as soon as the suction is activated.

In the example illustrated, on the surface of the core A2 a strip of glue has been applied parallel to the axis of the core. Said strip of glue is located, in the set-up shown in FIG. 1A, slightly upstream of the pinching point of the web material N and therefore after a brief rolling movement of the core, the material sticks to the core.

Since the rollers 1 and 11 continue to rotate, after breakage of the web material the feed member 13 continues to roll and to feed the core A2 along the channel 17. The point of contact between core and feed member 13 exceeds the suction area (FIG. 1B) and the initial free edge Li of the web material N adheres to the core due to the strip of glue applied on it, thus starting winding of a new log. The finished log R is still in the winding cradle, but could also have initiated its discharge movement. In this phase the suction has already been interrupted.

Figure 1B:
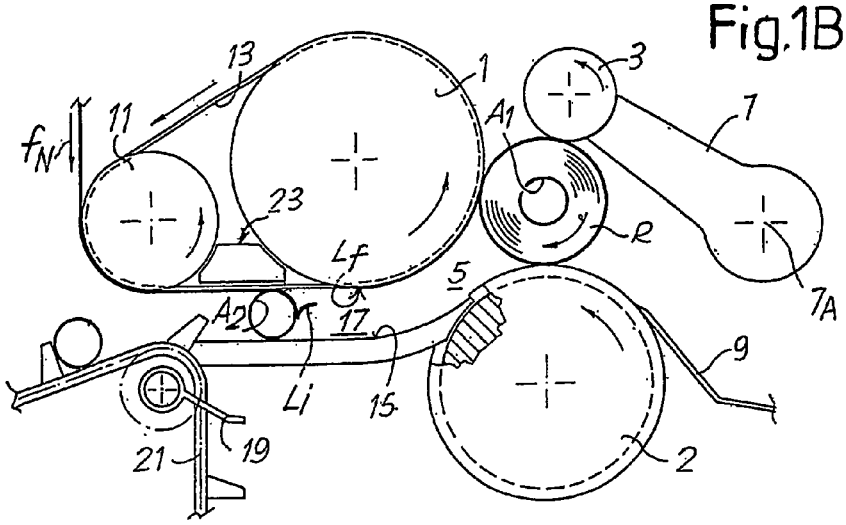
Figure 1C:
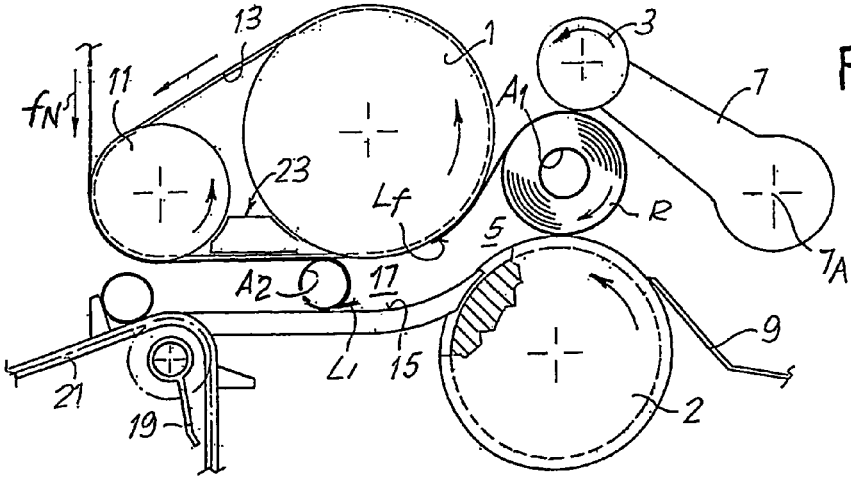

In FIG. 1C the winding core A2 has performed a further rotation of approximately 90° with respect to the position of FIG. 1B and the area of the initial free edge Li glued to the core begins to turn around the core, locating in the pressure area between the core and the rolling surface 15. The core A2 continues to roll until it reaches the winding cradle 1, 2, 3 passing through the nip 5. In the winding cradle formation of the next log around the core A2 is completed, the log R having been discharged by the winding cradle.

Once winding of the new log around the core A2 has been completed, the switchover cycle described above is repeated.

Instead of using glue to obtain adhesion of the initial free edge Li around the core and formation of the first turn around the core, one or more sets of blower nozzles can be used, appropriately arranged around the area in which the core receives the free edge. This solution is facilitated by the fact that below the rolling surface 15 no mechanical members are provided for tearing the web material, as in other known machines. For example nozzles can be provided arranged above and below the channel 17, appropriately directed to force the free edge to wind around the core forming the first turn, as will be described subsequently with reference to a further embodiment example.

Figure 2A:
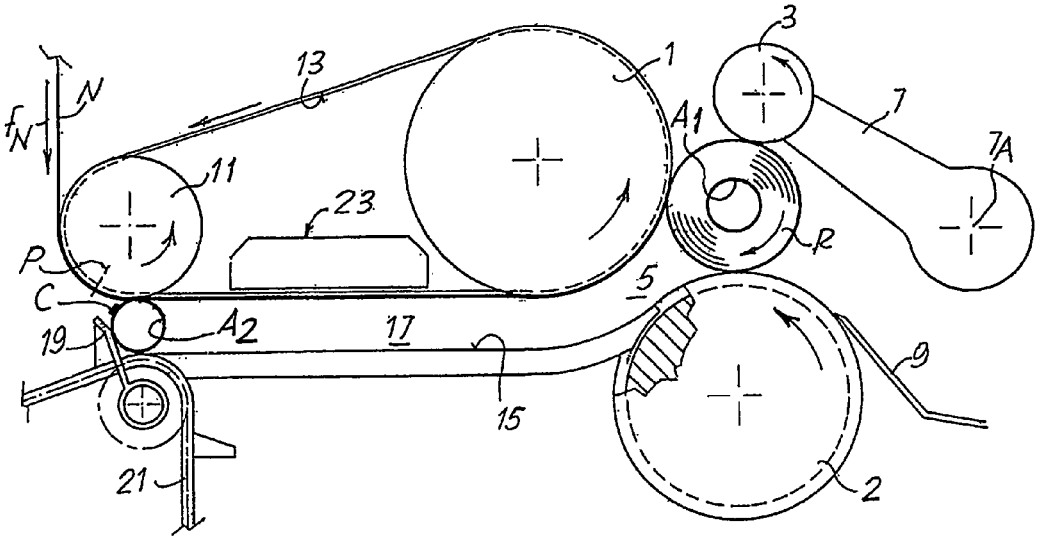
FIG. 2A to 2D show an operating sequence of a machine according to the invention in a second embodiment.
Figure 2B:
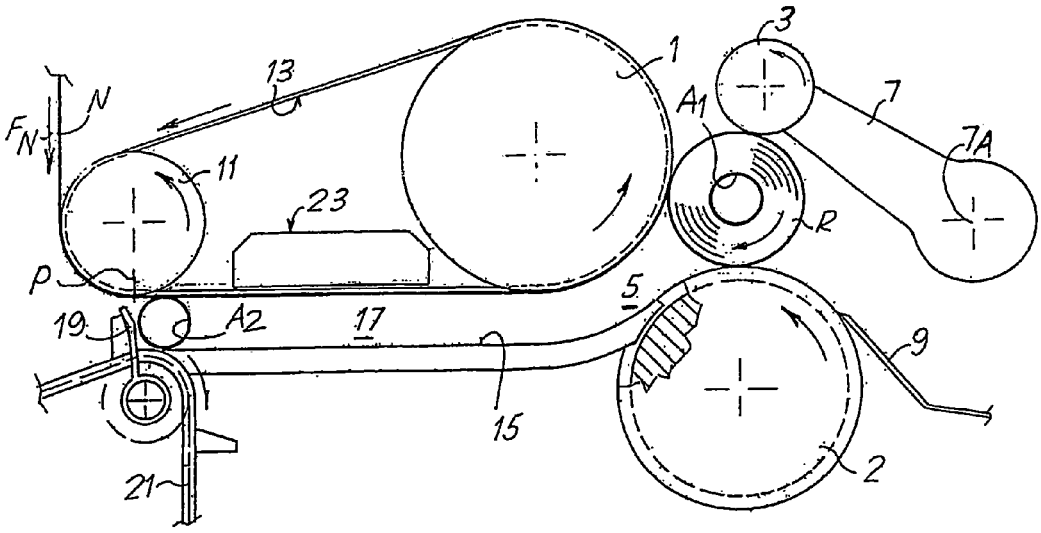

FIG. 2A-2D show a second embodiment of the machine according to the invention, with respective operating sequence. Equal numbers indicate parts equal or corresponding to those of the preceding FIG. 1A-1C. The main difference with respect to the preceding embodiment example is the greater distance between the rollers 1 and 11 and the greater extent of the counter surface defined by the suction member 23 and the belts 13A. Otherwise, the arrangement and the operating sequence is substantially the same. In the example illustrated in FIG. 2A-2D, however, the core performs a complete rotation in the channel 17 before interruption of the web material, as can be observed from the comparison between FIGS. 2A and 2C. The strip of glue is indicated by C. When the core is about to be inserted in the channel 17 (FIG. 2A) it is positioned so that it comes into contact with the web material after a moderate rotation of the core and therefore after it has been fed forward for a limited distance into the channel 17. FIG. 2B shows the moment when the strip of glue C comes into contact with the web material. P again indicates the position of the perforation line along which the web material will be torn. In FIGS. 2A and 2B said perforation line is upstream of the core A2.

When it is in the position of FIG. 2B, the winding core A2 yields part of the glue C to a portion of the web material N downstream of the perforation line P along which the web material will be subsequently interrupted and in the vicinity of said line. Therefore, part of the glue (indicated in the subsequent figures by C1) is transferred to the final free edge of the log R.

Figure 2C:
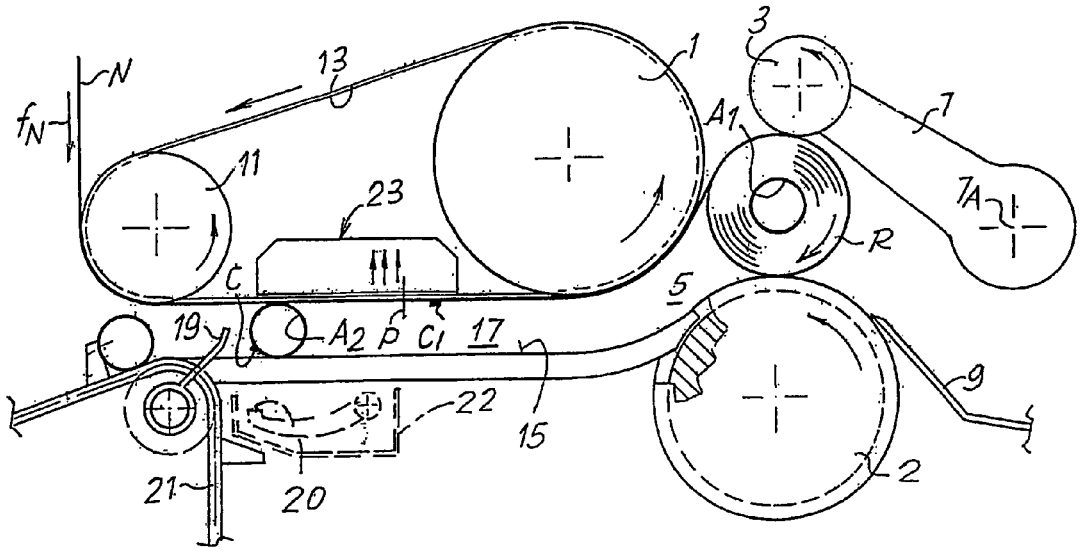

In FIG. 2C the suction begins, braking the web material N which breaks along the perforation line P, which at this point has passed beyond the position of the winding core A2 and is downstream of it with respect to the feed direction of the web material. This is due to the fact that the axis of the core A2 moves along the channel 17 at half the feed speed of the web material so that the point of contact between core A2 and web material N also moves forward along the channel at a speed equal to half of the feed speed of the perforation line P. In the set-up shown in FIG. 2C the strip of glue C is in the lower part of the core. To prevent the glue dirtying the rolling surface 15 during this movement, simply ensure that the surface bars are spaced from each other, and that the strip of glue C is interrupted at the bars.

The broken line in FIG. 2C indicates an auxiliary glue dispenser consisting of an oscillating element 20 which can be immersed in a glue container 22. The oscillating element is shaped so that it can be inserted between the laminas forming the surface 15 until it touches the core A2 in order to apply on it in the required position a strip of glue C, which can overlap the one previously applied and partially transferred in C1 to the final free edge of the log being completed. In this way two results are obtained: the quantity of glue is restored and a glue is applied which can have different qualities from those of the glue previously applied and partly at least transferred to the final free edge, in view of the fact that the final free edge of the log must be glued lightly so that it can be easily opened by the end user, while the initial free edge of the new log must adhere securely and immediately to the new core, with a glue that is as sticky as possible in order to guarantee a better grip.

Figure 2D:
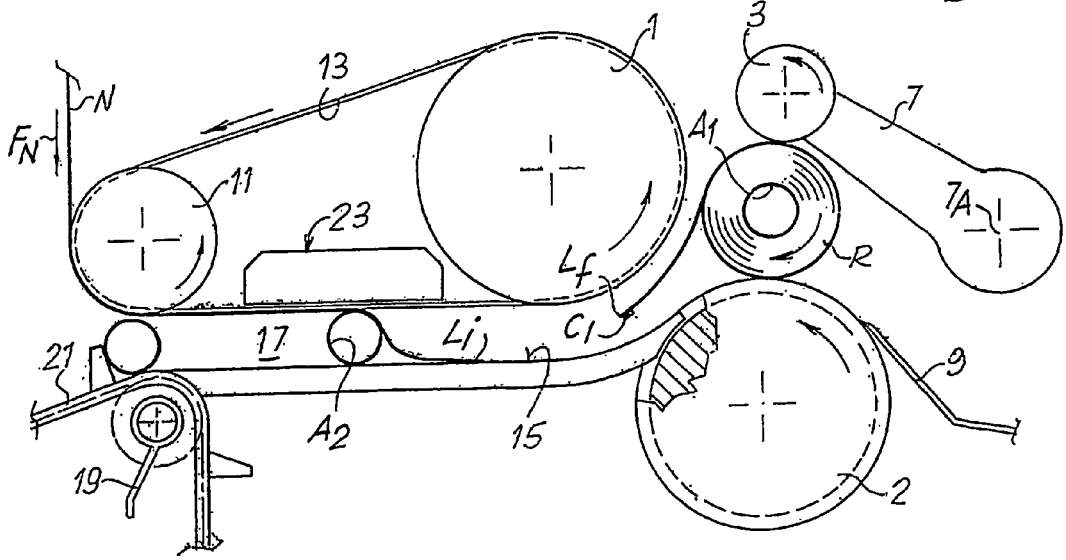

In FIG. 2D the final free edge Lf formed by the tear and provided with a strip of glue C1 transferred from the core A2 finishes winding on the log R during discharge from the winding cradle, while the core A2 is further fed along the channel 17, until it brings the strip of glue C into contact for the second time with the web material. This time, since the web material N is interrupted and the suction no longer operates on the new core, the initial free edge Li adheres to the core and winding of the new log begins. The core A2 will continue to roll and move forward along the channel 17 until it reaches the nip 5 and goes beyond it, entering the winding cradle 1, 2, 3.

Figure 3:
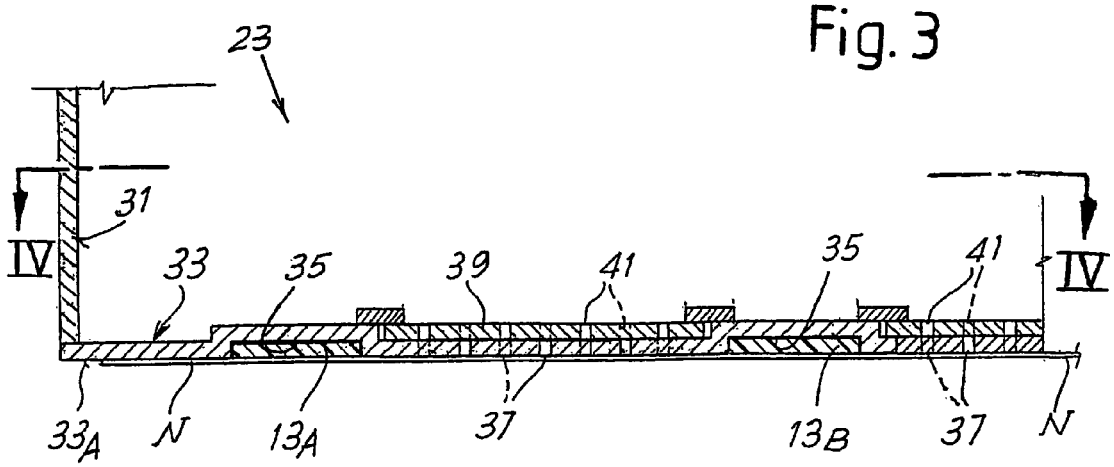
FIG. 3 shows a partially enlarged section view, according to a plane crosswise to the feed direction of the web material, of the suction member and the winding core feed member.
Figure 4:
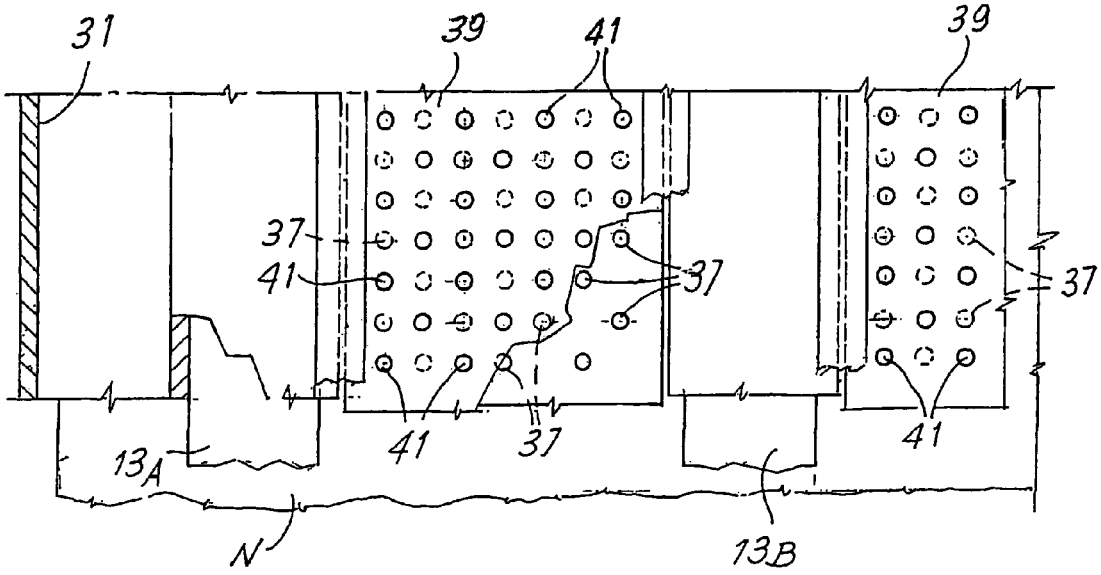
FIG. 4 shows a partial section according to IV-IV of FIG. 3.

FIGS. 3 and 4 show a cross section and a section according to IV-IV of FIG. 3, respectively, of the suction member 23. It has a suction box 31 the bottom of which is defined by a wall 33 along the outer surface 33A of which the web material runs. The outer surface of the wall 33 forms a counter surface on which the web material runs and against which it is pressed by the winding core which is inserted in the channel 17 at each switchover cycle. The wall 33 forms housings 35 parallel to the feed direction of the web material N, within which the parallel belts 13A forming the feed member 13 run. The outer surfaces of the belts 13A are flush with the outer surface 33A of the wall 33 or slightly protruding from it.

Between adjacent belts 13A the wall 33 is provided with respective perforated portions, i.e. through holes, openings or apertures 37. At the level of these perforated portions inside the suction box 31 diaphragms or laminas 39 are provided sliding parallel to the feed direction of the web material N, also provided with holes 41 staggered with respect to the holes 37, as can be seen in particular in FIG. 4. The diaphragms or laminas 39 form closing and opening elements which, sliding alternatively in one direction and the other, open and close the holes 37 alternatively communicating with the inside of the suction box 31 or intercepting said communication. In this way, with the diaphragms 39 moving alternatively in one direction and the other, the suction is activated and deactivated in a timed manner according to the position of the perforation line P for tearing of the web material. The inside of the suction box 31 can remain constantly at an underpressure, i.e. at a pressure below the atmospheric pressure, thus guaranteeing rapid cut-in of the suction even when the winding cycle is very short. The underpressure in the suction box 31 is maintained for example by means of connection to a vacuum pump, a fan or other suitable suction means not shown.

Figure 5:
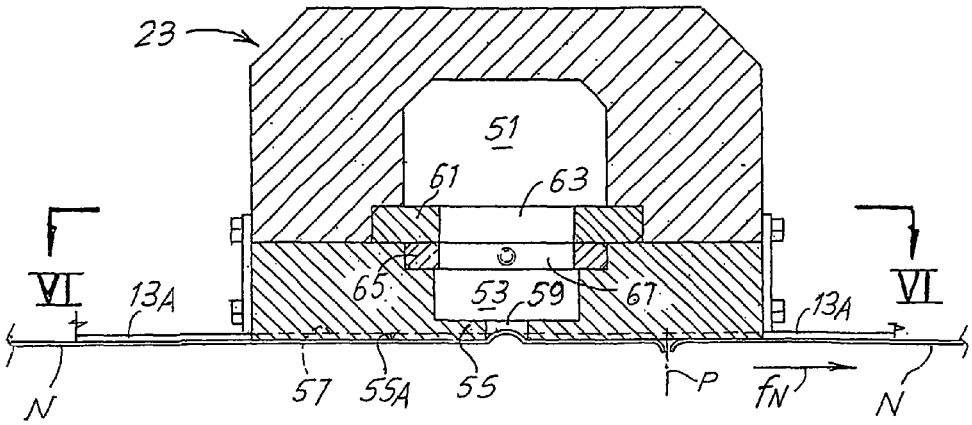
FIG. 5 shows a section of the suction member in a different embodiment.
Figure 6:
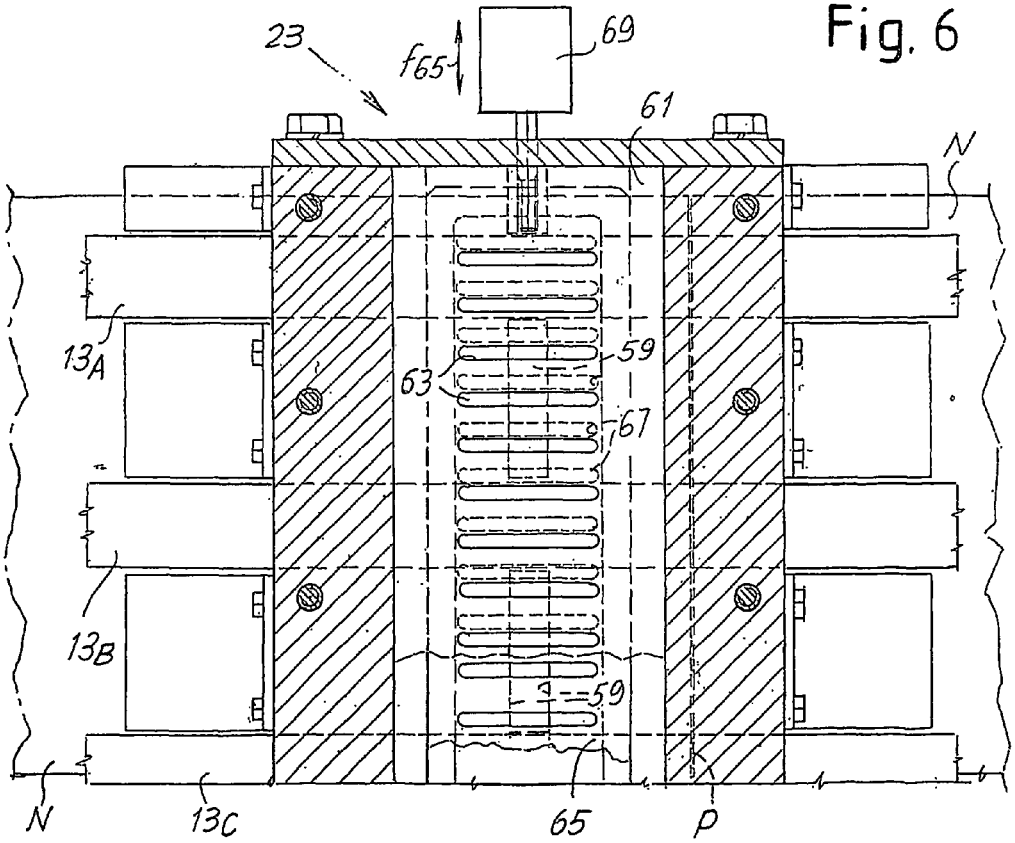
FIG. 6 shows a section according to VI-VI of FIG. 5.

FIGS. 5 and 6 show a different configuration of the suction member. In this case the suction member 23 comprises a continuous suction chamber 51, i.e. a chamber in which a pressure below the atmospheric pressure is constantly maintained. This chamber can be connected, at certain set times, to a timed suction chamber 53, the lower wall of which 55 defines a counter surface 55A having functions analogous to those of the counter wall 33A described above. In the wall 55 housings 57 are provided in which the belts 13A forming the feed member 13 run.

The wall 55 has a crosswise slot or aperture 59, if necessary interrupted at the level of the belts 13A. Via this crosswise aperture or slot 59 the braking suction effect is applied on the web material N causing breakage thereof along the perforation line P. To obtain a suction effect correctly controlled over time, of appropriate duration and timed with the passage of the perforation line P, the chambers 53 and 55 are connected via a valve system comprising a fixed plate 61 to a series of apertures or slots 63 elongated according to the feed direction of the web material N and positioned side by side crosswise to the feed direction. Below the fixed plate 61 is a sliding plate 65 provided with slots or apertures 67 extending analogously to the apertures or slots 63. The sliding plate 65 is furthermore connected to an actuator 69 which controls timed sliding of the plate according to the double arrow f65 (FIG. 6).

As can be observed in FIG. 6, the two plates 61 and 65 can be positioned so that the slots 63 and 67 are staggered and therefore the two suction chambers 51 and 53 are isolated from one another. In this case no suction is applied on the web material N. This is the set-up during normal winding of the log R. When the web material has to be torn or interrupted, the movable plate 65 is translated in one direction or the other according to the arrow f65 to align the apertures or slots 67 with the slots 63 (as in FIG. 6), and therefore connect the suction chamber 53 to the suction chamber 51. In this set-up the suction effect is exerted on the web material N, braking it and thus causing it to tear.

Figure 7:
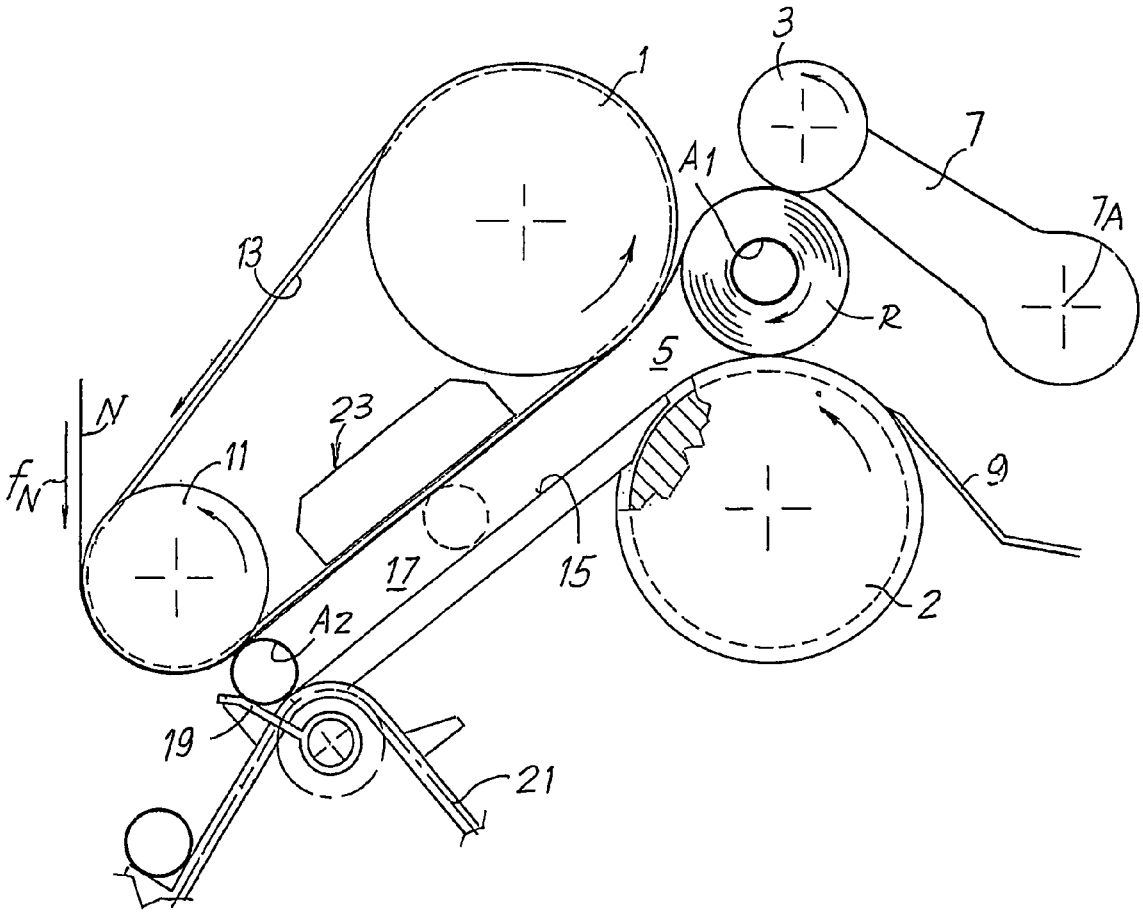
FIG. 7 shows a side view of a machine according to the invention in a further embodiment.
Figure 8:
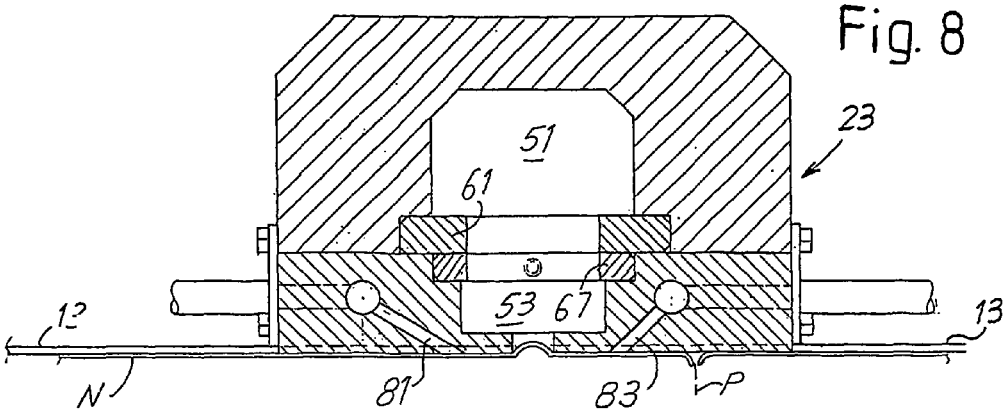
FIG. 8 shows a section of the suction member, analogous to the section of FIG. 5, in a different embodiment.
Figure 9A:
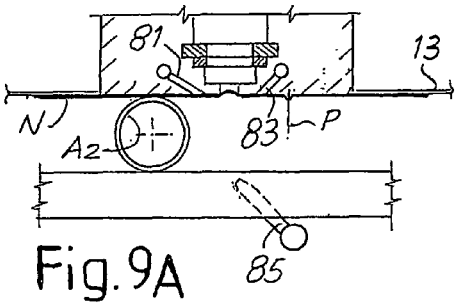
FIG. 9A-9E show schematically the sequence of the tear or interruption phase of the web material and beginning of formation of the first turn of the new log around the new core, assisted by jets of air and without glue.
Figure 9B:
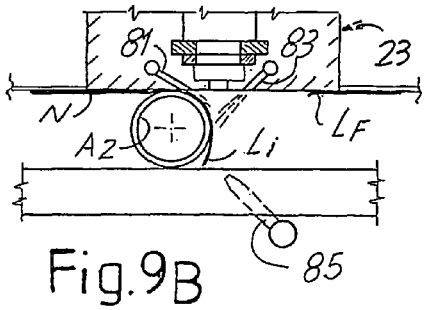
Figure 9C:
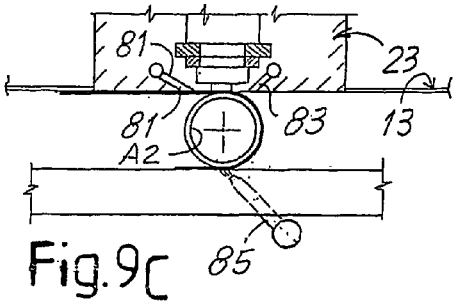
Figure 9D:
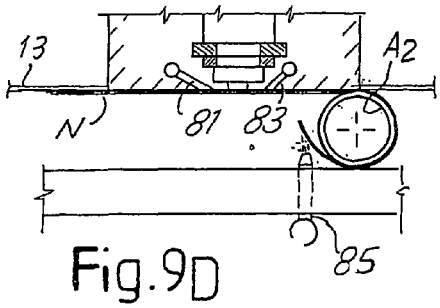
Figure 9E:
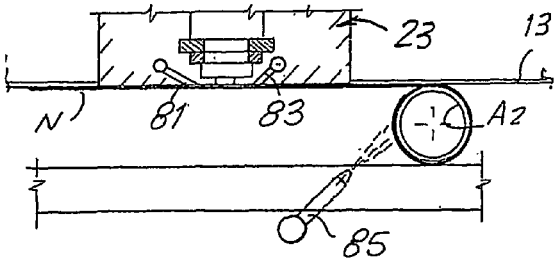

FIG. 7 shows an embodiment analogous to the embodiment of FIG. 2A-2D. Equal numbers indicate equal or equivalent parts in the two configurations. In this case, moreover, the channel 17 and the rolling surface 15 have a straight-line development and the winding rollers 1 and 2 have the same diameter. This means that the winding cores can be given a straight path. This is particularly advantageous when the movement of the cores is controlled by mandrels inserted inside them, as described for example in WO-A-02055420.

The operating principle of the machine according to the invention offers a series of advantages with respect to other known systems. Among other things, the absence of mechanical members for interruption of the web material and the presence of a core insertion channel upstream of the winding roller 1 with a suction box permits, if required, easy positioning of air blowing nozzles to start winding without the use of glue. This makes it easier to produce logs with a central hole but without winding core. In fact, the absence of glue permits the use of cores, if necessary recyclable, which are easy to slide out of the finished log. The cores, made of plastic for example, can be easily re-used without the need to remove any remains of glue.

The use of jets of air can be advantageous also in the case of use of glue. In fact, they ensure correct winding of the core by the web material before rolling of the core causes the longitudinal strip of glue to come into contact with the rolling surface 15, if necessary partially exposed (i.e. not covered by the web material N) as a result of the ventilation caused by the high machine operating speed. This makes the machine more reliable, reduces maintenance and cleaning and avoids the need for a rolling surface 15 with comb-type structure to prevent contact with the glue.

FIGS. 8 and 9A-9E show—limited to the suction and breakage area of the web material N—an embodiment example in which the initial free edge Li generated by tearing of the web material is wound around the new core A2 without the use of glue. The suction member 23 is constructed as in the example of FIG. 5. However, in this case, in the block forming the lower wall 55 two sets of nozzles are provided, indicated by 81 and 83 respectively. These nozzles slant differently with respect to the surface 55A and are arranged on opposite sides of the suction aperture or slot 59. Below the rolling surface 15 a third set of nozzles is provided indicated by 85. While the nozzles 81 and 83 are fixed, the series of nozzles 85 oscillates around a horizontal axis, crosswise with respect to the feed direction of the web material N. The oscillation movement is shown in the sequence of FIG. 9A-9E.

Operation of the machine in this embodiment example is as follows. When the core A2 is upstream of the outlet of the nozzles 81 and the suction aperture 59, the suction is activated and the web material is torn or interrupted at the perforation line P directly downstream of the suction aperture. The nozzles 81 begin to blow downwards, while the suction is interrupted. The jet of air generated by the nozzles 81, which extend over the whole width of the machine, or at least a large part of it, pushes down the initial free edge Li, detaching it from the lower surface 55A of the wall 55. This winds the initial free edge around the new core which, in the meantime, moves forward rolling on the surface 15. Activation of the nozzles 83 pushes the free edge below the core, between the latter and the surface 15.

The jets of air generated by the nozzles 85 also induce the free edge to wedge between the core A2 and the surface 15. When, in its rolling movement, the core A2 goes beyond the vertical plane containing the oscillation axis of the lower oscillating nozzles 85, the latter begin to oscillate in a clockwise direction, consequently rotating the jet of air generated so that it is correctly positioned to push the initial free edge Li to complete formation of the first turn around the core A2.

When the first turn has been completed, the web material N is correctly engaged on the new core and winding of the new log begins.

From the description referring to the use of jets of air generated by the compressed air nozzles 81, 83, 85, it appears clear that in the log which is formed, the first turn, i.e. the innermost turn, is without fold, i.e. it does not turn back in the opposite direction with respect to the winding direction of the remaining part of the web material, as happens in the embodiments described in the preceding examples. This holds true both in the case of a log without central core, i.e. with a hole left by extraction of an extractable recyclable core, and in the case of a log formed around a core which remains inside the log. Furthermore, said advantageous conformation of the log is obtained also in the case of the combined use of glue and air nozzles, obtaining an advantageous result which was previously not possible when the gluing was performed with a longitudinal strip of glue.

In addition to the advantages referred to above, the system of interruption by suction also makes it easier to adapt the machine to different winding core diameters. In fact, the winding cores are inserted in a channel 17 defined by a rolling surface 15 which is for the most part straight and with any curves only in an end section. It is therefore possible to adapt the machine to cores of variable diameter by simply translating the bars that form the rolling surface 15, together with the lower roller in the example illustrated.

In some configurations, and in particular in that of FIG. 1A-1C, the rolling surface 15 could consist of a simple metal sheet, if necessary interrupted to permit passage of the taker-in 19 but without the need for a comb-type structure throughout its length. This prevents also the first turn of the web material being damaged by the mark left by the comb structure laminas.

The use of a pneumatic system for interrupting the web material makes operation more regular and less subject to wear, noise and vibration compared to systems in which the web material is interrupted by pinching the material against a winding roller or a belt by means of a movable mechanical member at a different speed with respect to the feed speed of the web material. On the other hand, all the advantages in terms of dependability and flexibility of the preceding systems are maintained.

The suction member can be adjusted in position along the length of the channel 17. This facilitates adjustment and set-up of the machine as it makes it simpler to synchronize cut-in of the suction system with respect to the position of the perforation line. The position of the suction member 23 constitutes an additional adjustment parameter with respect to control of opening and closing of the suction apertures. This is easy to implement because the distance between the rollers 1 and 11 is considerable with respect to the section traveled by the web material N during the very brief suction activation time.

The drawing only shows practical embodiments of the invention, which can vary in the forms and arrangements without departing from the scope of the concept underlying the invention. The presence of reference numbers in the appended claims has the sole aim of facilitating reading thereof in the light of the description and appended drawings, but does not limit the scope of its protection in any way.

The invention claimed is:

1. A rewinding machine comprising a winding system, a feed path for feeding a web material towards said winding system, a counter surface along which said web material runs, and at least one suction member positioned along said feed path to temporarily obstruct feed of the web material and cause interruption thereof at an end of winding of each log, wherein said at least one suction member and said counter surface are constructed and arranged such that said suction member attracts said web material onto said counter surface to generate a friction between the web material and said counter surface which causes breakage of said web material by tearing.

2. The rewinding machine as claimed in claim 1, wherein said winding system is a surface winding system comprising a winding cradle.

3. The rewinding machine as claimed in claim 2, further comprising a winding core feeder constructed and arranged to feed winding cores into an insertion path towards said winding cradle.

4. The rewinding machine as claimed in claim 3, wherein positioned along said insertion path is at least one winding core feed member which moves forward at a speed substantially equal to a speed of the web material.

5. The rewinding machine as claimed in claim 4, wherein positioned along said insertion path is a rolling surface for said cores which forms with said at least one core feed member an insertion channel for the winding cores.

6. The rewinding machine as claimed in claim 5, wherein said rolling surface and said at least one core feed member are arranged so that the web material is fed between a core and the at least one core feed member when the core is in said insertion path.

7. The rewinding machine as claimed in claim 5, wherein said counter surface is opposed to said rolling surface, cores being inserted between said counter surface and said rolling surface such that the web material is positioned between the cores and the counter surface.

8. The rewinding machine as claimed in claim 4, wherein said at least one core feed member feeds cores along said counter surface.

9. The rewinding machine as claimed in claim 3, wherein said insertion path is substantially rectilinear.

10. The rewinding machine as claimed in claim 3, wherein the insertion path is constructed and arranged so that each core rolls along said insertion path for a distance sufficient to transfer a portion of glue previously applied on said core to a portion of the web material forming a final free edge of the log.

11. The rewinding machine as claimed in claim 1, wherein said at least one suction member is in a substantially fixed position.

12. The rewinding machine as claimed in claim 1, wherein said at least one suction member is movable at a substantially different speed from a feed speed of the web material.

13. The rewinding machine as claimed in claim 1, wherein provided along said counter surface is at least one suction aperture extending in a direction crosswise to a feed direction of the web material.

14. The rewinding machine as claimed in claim 1, wherein said at least one suction member comprises a sliding valve providing opening and closing of suction holes via which said at least one suction member applies suction on said web material, said sliding valve being activated in connection with a switchover phase of a winding cycle performed by said rewinding machine.

15. The rewinding machine as claimed in claim 1, wherein said at least one suction member includes at least one aperture crosswise to a feed direction of the web material.

16. The rewinding machine as claimed in claim 15, wherein said at least one aperture communicates with a timed suction chamber which is structured for connection to a suction source.

17. The rewinding machine as claimed in claim 1, further comprising a glue applicator for applying glue on cores.

18. The rewinding machine as claimed in claim 1, further comprising blower nozzles to facilitate winding of a free edge around a winding core.

19. The rewinding machine as claimed in claim 18, wherein winding of each log is started by said blower nozzles without application of glue to winding cores.

20. A rewinding machine comprising a winding system, wherein said winding system is a surface winding system including a first winding roller and a second winding roller defining a nip therebetween; a feed path for feeding a web material towards said winding system; a counter surface along which said web material runs; and at least one suction member positioned along said feed path to temporarily obstruct feed of the web material and cause interruption thereof at an end of winding of each log; wherein said at least one suction member and said counter surface are constructed and arranged to generate a friction between the web material and said counter surface which causes breakage of said web material by tearing; and wherein said at least one suction member is arranged upstream of said nip with respect to a feed direction of said web material.

21. A rewinding machine comprising a winding system; a feed path for feeding a web material towards said winding system; a counter surface along which said web material runs, wherein said counter surface is a fixed surface; and at least one suction member positioned along said feed path to temporarily obstruct feed of the web material and cause interruption thereof at an end of winding of each log; wherein said at least one suction member and said counter surface are constructed and arranged to generate a friction between the web material and said counter surface which causes breakage of said web material by tearing.

22. A rewinding machine comprising a winding system, wherein said winding system is a surface winding system comprising a winding cradle; a feed path for feeding a web material towards said winding system; a winding core feeder constructed and arranged to feed winding cores into an insertion path towards said winding cradle, and positioned along said insertion path is at least one winding core feed member which moves forward at a speed substantially equal to a speed of the web material; a counter surface along which said web material runs; at least one suction member positioned along said feed path to temporarily obstruct feed of the web material and cause interruption thereof at an end of winding of each log; wherein said at least one suction member and said counter surface are constructed and arranged to generate a friction between the web material and said counter surface which causes breakage of said web material by tearing; and wherein said at least one winding core feed member comprises at least one flexible member running along said counter surface.

23. A rewinding machine comprising a winding system including a winding cradle; a feed path for feeding a web material towards said winding system; a counter surface along which said web material runs; at least one suction member positioned along said feed path to temporarily obstruct feed of the web material and cause interruption thereof at an end of winding of each log, wherein said at least one suction member and said counter surface are constructed and arranged to generate a friction between the web material and said counter surface which causes breakage of said web material by tearing; and a first winding roller around which at least one flexible member runs with which the web material fed to said winding cradle is in contact and in which said at least one suction member is combined with said flexible member, said suction member presenting said counter surface, the flexible member moving along said counter surface.

24. The rewinding machine as claimed in claim 23, further comprising a second winding roller defining with said first winding roller a nip for passage of the web material.

25. The rewinding machine as claimed in claim 24, wherein said nip is positioned substantially at an end of said insertion path of the winding cores.

26. The rewinding machine as claimed in claim 25, wherein said insertion path, said nip and said first winding roller and said second winding roller are constructed and arranged so that the winding core moves in a substantially rectilinear direction along said insertion path and during a winding phase in contact with said first winding roller and said second winding roller.

27. A rewinding machine comprising a winding system, a feed path for feeding a web material towards said winding system, a counter surface along which said web material runs, and at least one suction member positioned along said feed path to temporarily obstruct feed of the web material and cause interruption thereof at an end of winding of each log, wherein said at least one suction member and said counter surface are constructed and arranged to generate a friction between the web material and said counter surface which causes breakage of said web material by tearing, wherein said at least one suction member includes at least one aperture crosswise to a feed direction of the web material, wherein said at least one aperture communicates with a timed suction chamber which is structured for connection to a suction source, and wherein said timed suction chamber is structured for connection by an opening and closing member to a continuous suction chamber where a substantially continuous underpressure is maintained.

28. The rewinding machine as claimed in claim 27, wherein said opening and closing member comprises a sliding plate provided with a plurality of apertures, wherein said plate is positioned so that said apertures are aligned or alternatively offset with respect to corresponding apertures in a separation wall between said timed suction chamber and said continuous suction chamber.

29. The rewinding machine as claimed in claim 28, wherein said apertures in the plate and said apertures in the separation wall have an elongated configuration in the feed direction of the web material.

30. A rewinding machine comprising a winding system, a feed path for feeding a web material towards said winding system, a counter surface along which said web material runs, at least one suction member positioned along said feed path to temporarily obstruct feed of the web material and cause interruption thereof at an end of winding of each log, wherein said at least one suction member and said counter surface are constructed and arranged to generate a friction between the web material and said counter surface which causes breakage of said web material by tearing, and blower nozzles to facilitate winding of a free edge around a winding core, wherein said blower nozzles include at least one first set of blower nozzles and one second set of blower nozzles arranged upstream and downstream of a suction application area to the web material.

31. The rewinding machine as claimed in claim 30, wherein said first set of blower nozzles and said second set of blower nozzles are arranged on a common side of a core insertion path.

32. The rewinding machine as claimed in claim 30, further comprising a third set of blower nozzles.

33. The rewinding machine as claimed in claim 32, wherein at least one of said first set, said second set or said third set of blower nozzles is oscillating or rotating around an axis crosswise with respect to the feed direction of the web material.

34. The rewinding machine as claimed in claim 32, wherein said third set of blower nozzles is oscillating.

35. The rewinding machine as claimed in claim 32, wherein said third set of blower nozzles is arranged on an opposite side of the core insertion path with respect to said first set of blower nozzles and said second set of blower nozzles.

36. Method for producing logs of wound web material comprising feeding a web material along a feed path towards a winding system, a counter surface being arranged along said feed path and said web material sliding along said counter surface;

winding a first log of the web material; and interrupting the web material at an end of winding of said first log, forming a final free edge of said first log and an initial free edge for winding of a second log; wherein said interrupting of the web material is by timed suction which obstructs the feeding of the web material and generates a friction between the web material and said counter surface along which said web material slides, said friction causing breakage of said web material.

37. The method as claimed in claim 36, wherein said winding system is a surface winding system comprising a winding cradle.

38. The method as claimed in claim 37, wherein said winding of said logs includes winding of the web material on winding cores, said winding cores being fed along an insertion path towards said winding cradle.

39. The method as claimed in claim 38, wherein said counter surface extends along said insertion path.

40. The method as claimed in claim 39, including providing a core feed member along said counter surface.

41. The method as claimed in claim 40, including moving said core feed member at a speed substantially corresponding to a feed speed of the web material.

42. The method as claimed in claim 40, including passing the web material between said feed member and the core which presses the web material against the feed member.

43. The method as claimed in claim 38 including moving a winding core along said counter surface with the web material being fed between the counter surface and the winding core, the winding core advancing in contact with the web material at a common feed speed with the web material.

44. The method as claimed in claim 43, including applying said timed suction downstream of a position of said winding core along the insertion path causing said interrupting of the web material downstream of said winding core.

45. The method as claimed in claim 38, including applying glue on said winding cores.

46. The method as claimed in claim 45, wherein said applying of said glue is along at least one longitudinal line on said winding cores.

47. The method as claimed in claim 45, wherein at least a part of said glue is transferred to a portion of the final free edge to serve to close the final free edge of said log.

48. The method as claimed in claim 38, wherein said winding of the web material on the winding cores is by winding of the initial free edge around said winding core which is started or facilitated by one or more jets of air.

49. The method as claimed in claim 36, wherein said counter surface is movable at a different speed with respect to a feed speed of the web material.

50. The method as claimed in claim 36, including providing at least one suction aperture along said counter surface and applying said timed suction on said web material when the web material moves along said counter surface.

51. Method for producing logs of wound web material comprising feeding a web material to a winding system, wherein said winding system is a surface winding system comprising a winding cradle;

winding a first log of the web material;

interrupting the web material at an end of winding of said first log, forming a final free edge of said first log and an initial free edge for winding of a second log, wherein said interrupting of the web material is by timed suction which obstructs the feeding of the web material and generates a friction between the web material and a counter surface, said friction causing breakage of said web material;

feeding the web material through a nip formed between a first winding roller and a second winding roller; and applying said timed suction upstream of said nip with respect to a feeding direction of said web material.

52. Method for producing logs of wound web material comprising feeding a web material to a winding system;

winding a first log of the web material; and interrupting the web material at an end of winding of said first log, forming a final free edge of said first log and an initial free edge for winding of a second log, wherein said interrupting of the web material is by timed suction which obstructs the feeding of the web material and generates a friction between the web material and a counter surface, said friction causing breakage of said web material, wherein said counter surface is fixed.

* * * * *